US011454231B2

(12) United States Patent
Prodan

(10) Patent No.: US 11,454,231 B2
(45) Date of Patent: Sep. 27, 2022

(54) HORIZONTAL GAS COMPRESSOR WITH FREE LIFTING PISTON

(71) Applicant: COMPRESSOR PUMP INDUSTRIAL SRL, Bucharest (RO)

(72) Inventor: Marian Prodan, Bucharest (RO)

(73) Assignee: COMPRESSOR PUMP INDUSTRIAL SRL, Bucharest (RO)

( * ) Notice: Subject to any disclaimer, the term of this patent is extended or adjusted under 35 U.S.C. 154(b) by 0 days.

(21) Appl. No.: 17/044,325

(22) PCT Filed: May 29, 2019

(86) PCT No.: PCT/RO2019/000016
§ 371 (c)(1),
(2) Date: Sep. 30, 2020

(87) PCT Pub. No.: WO2020/013722
PCT Pub. Date: Jan. 16, 2020

(65) Prior Publication Data

US 2021/0102535 A1 Apr. 8, 2021

(30) Foreign Application Priority Data

Jun. 8, 2018 (RO) ..... a 2018 00406

(51) Int. Cl.
*F04B 39/12* (2006.01)
*F04B 5/02* (2006.01)
(Continued)

(52) U.S. Cl.
CPC ..... *F04B 39/126* (2013.01); *F04B 5/02* (2013.01); *F04B 35/01* (2013.01);
(Continued)

(58) Field of Classification Search
CPC ..... F04B 53/144; F04B 53/006; F04B 53/16; F04B 53/18; F04B 2201/0206; F04B 5/02; F04B 39/0005
See application file for complete search history.

(56) References Cited

U.S. PATENT DOCUMENTS 2,695,132 A * 11/1954 Paget ..... F04B 5/02 417/254
5,440,183 A 8/1995 Denne
(Continued)

FOREIGN PATENT DOCUMENTS

CN 205117706 U 3/2016
FR 2627236 A1 8/1989
(Continued)

OTHER PUBLICATIONS

English Machine Translation of Abstract for JP-04001454-A (Year: 1992).*
(Continued)

*Primary Examiner* — Nathan C Zollinger
(74) *Attorney, Agent, or Firm* — Hershkovitz & Associates, PLLC; Abe Hershkovitz

(57) ABSTRACT

A reciprocating gas horizontal compressor with free lifting piston, which includes a piston with straight ends and inclined compression chambers, a crankcase in which are mounted a crankshaft, a connecting rod fixed to a cross head thru a bolt which alternately drives in a cross-head body a piston rod, and a cylinder body which contains a cylinder liner in which is moving rectilinear and alternatively an improved piston provided with straight ends and compression chambers inclined in areas (m) and (k), with the same angle and in the same plane as a zone (p) from a first cylinder head element and respectively in a zone (n) from a second cylinder head element, and some magnets fixed to the piston and some magnets fixed outside and to a lower part of the
(Continued)

Figure 1:
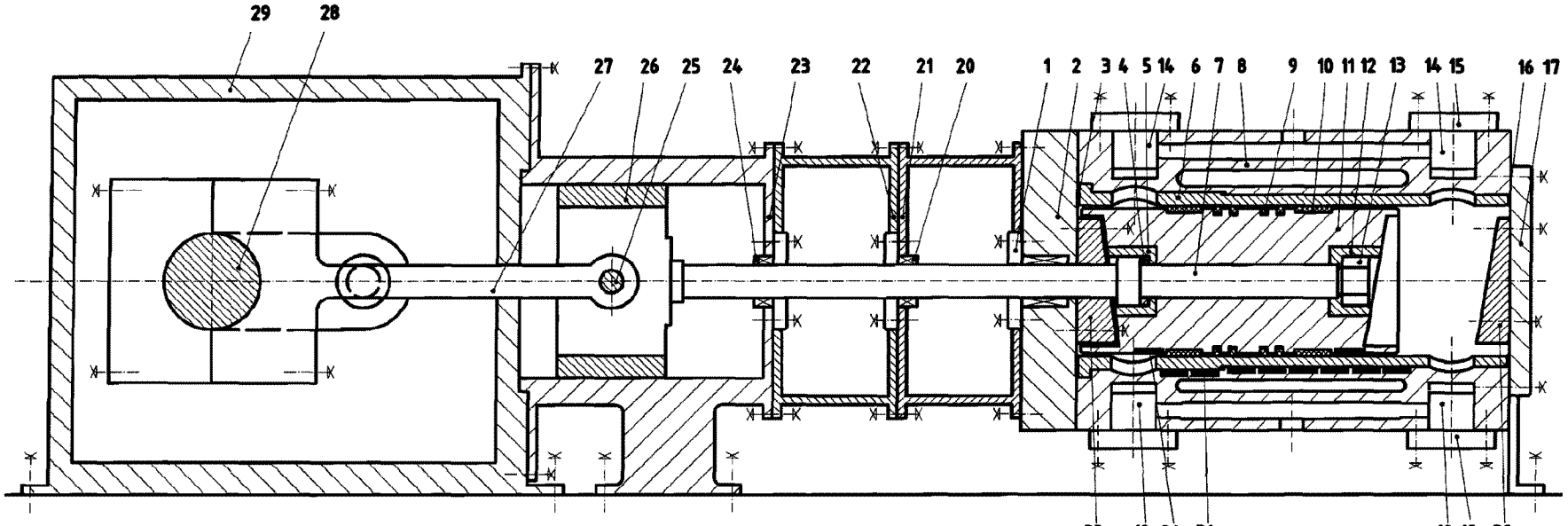

cylinder liner, through which the piston is free lifting on the stroke length with reduced friction.

7 Claims, 2 Drawing Sheets

(51) Int. Cl.
*F04B 35/01* (2006.01)
*F04B 39/00* (2006.01)

(52) U.S. Cl.
CPC ..... *F04B 39/0005* (2013.01); *F04B 39/122* (2013.01); *F04B 39/125* (2013.01)

(56) References Cited

U.S. PATENT DOCUMENTS

| | | | | |
|---|---|---|---|---|
| 5,622,486 | A * | 4/1997 | McDuffie | F04B 39/10 417/536 |
| 6,016,738 | A | 1/2000 | Elferink et al. | |
| 2018/0066802 | A1* | 3/2018 | Brun | F17D 1/08 |

FOREIGN PATENT DOCUMENTS

| | | | |
|---|---|---|---|
| JP | 04001454 | A * | 1/1992 |
| KR | 100310767 | B1 * | 2/2002 |
| RO | 131994 | A2 * | 6/2017 |
| RO | 131994 | A2 | 6/2017 |
| SU | 969962 | A1 | 10/1982 |
| WO | WO 2014/139565 | A1 | 9/2014 |

OTHER PUBLICATIONS

English Machine Translation of Abstract for KR-100310767-B1 (Year: 2002).*
English language Abstract of CN 205117706 U (Mar. 30, 2016).
English language Abstract of FR 2627236 A1 (Aug. 18, 1989).
English language Abstract of RO 131994 A2 (Jun. 30, 2017).
International Search Report in International Application No. PCT/RO2019/000016, dated Jan. 30, 2020.
Written Opinion of the ISA in International Application No. PCT/RQ2019/000016, dated Jan. 30, 2020.
Search Report in related Romanian Patent Application No. a 2018 00406, dated Oct. 31, 2018.
Written Opinion in related Romanian Patent Application No. a 2018 00406, dated Oct. 31, 2018.
English language translation of the pertinent part (Box. V) of the Written Opinion in related Romanian Patent Application No. a 2018 00406, dated Oct. 31, 2018.

* cited by examiner

HORIZONTAL GAS COMPRESSOR WITH FREE LIFTING PISTON

The invention relates to a horizontal gas compressor equipped with cylinders and free floating pistons used in industrial applications for compressing gas from refinery, petrochemical, chemical industry, storage, compression, methane gas transport or air compression, etc.

BACKGROUND OF THE INVENTION

General solutions for horizontal piston compressors manufacturing are known, and in particular those relating to:

Patent no. WO 2014139565 A1, belonging to Howden Thomassen Compressors BV, published on Sep. 18, 2014, including the patents mentioned therein. This patent includes a technical solution for a reciprocating horizontal compressor equipped with free lifting pistons and slides on a gas pillow; and Patent application A2015 00959, belonging to Compressor Pump Industrial, inventor Marian Prodan, published on Jun. 30, 2017 in the Bulletin Officiel de la Propriété Industrielle (French: Official Bulletin of Industrial Property) relating to a reciprocating horizontal compressor equipped with inclined piston heads.

The main disadvantages of WO 2014139565 A1 are:

- the gas used as a gas pillow, which comes from the hot gas from the compression chamber, will run through the piston's nozzle without cooling and will reach the other compression chamber by mixing with cold gas from suction; the suction cold gas will have an increase of suction temperature due to mixing of the cold gas aspirated with hot gas from the gas pillow;
- hot gas from the gas pillows will provide extra heat in the rider rings area when discharging through the gas pillow nozzle, preventing heat dissipation on the cold gas suction cycle to the suction gas; increasing the temperature at the level of the rider rings made from graphite Teflon or other material, increases the wear rate of rider rings;
- the gas outlet holes in the lower part of the piston cross the rider rings that can achieve the gas pillow conditions if they are made of a single piece stretched mounted on piston;
- it is a complicated solution;
- the suction orifice, with or without valve, and the discharge orifice and/or orifices, with or without valve, on the lower part of the piston made for achievement of the gas pillow, can easily be clogged with the contaminant present in gas, having the effect of no achievement of the gas pillow;
- the contaminant which is entering in the inside of the piston can only be cleaned by shutting down the compressor and completely removing the piston subassembly;
- the condition of laminating of the gas with achievement of gas pillow, involves the fulfillment of the reciprocal conditions of the surfaces in contact with micron deviations of the shapes, an impossible condition to be achieved in practice for medium and large process gasses compressors to which the patent refers;
- for achievement of the gas pillow, the loss of gas from the compressor flow is considerable if there is one orifice provided on each rider ring; where two holes can not meet, in terms of carrying capacity, any piston size due to the small size of gas pillow achieved by the two holes is also mentioned the achievement of the gas pillow option with much more orifices in each rider ring, which will result in even higher debit losses; and
- variation in gas pressure along the length stroke due to compressing phase and increasing of the pressure from the suction pressure to the discharge pressure, will take a pulsation and a variation of gas pressure inside the piston, hence to the discharge pressure of the gas at the bottom of the piston for achievement of the gas pillow, with discontinuity in maintaining the lamination of the gas conditions, with pulsatory achievement of the gas pillow between piston and cylinder liner over the stroke length and with the pulsating dimming of the free lifting effect.

The disadvantages of patent application No. A2015 00959 are that it does not allow manufacturing of a horizontal compressor with pistons with inclined compression chambers, where it is possible to have a free lifting piston with straight ends in inclined compression chambers.

SUMMARY OF THE INVENTION

The problem solved by the present invention relates to the manufacture a horizontal gas compressor equipped with double action cylinders and pistons with straight ends and inclined compression chambers, in which the piston is free lifted in the inclined compression chamber with minimal constructive modifications, for a straight head piston in the classic version, applicable to existing compressors or new compressors.

The horizontal gas piston compressor with free lifting piston, according to the invention, eliminates the above disadvantages noted in the prior art by using straight-head pistons and inclined compression chambers, one at each end of the piston, together with the inclined cylinder head fitted to the existing cylinder and additionally equipping of the piston and the cylinder with sectors of permanent magnets support for additional guidance of the piston on the length stroke, inside the cylinder on a magnetic pillow to reduce the weight and friction forces, including wear.

The horizontal compressor with free lifting piston of the present Application has the following advantages:

- it provides a constructive solution of a compressor with a straight piston head and inclined compression chambers and magnetic pillow while reducing weight, friction and wear, in simplified terms, regardless of the application or the size of the compressor, keeping the straight head shape of the piston;
- the free lifting of the piston and piston rod in the compressor is not influenced by the gas contaminant under the normal operating conditions;
- free lifting of the piston and piston rod in the compressor, does not involve additional flow loss from the discharge to the suction;
- the free lifting of the piston in the compressor is made by direct action of the pressure on the inclined surface of the piston head and by sliding on the magnetic pillow;
- it is not necessary to pressurize the piston to assure the free lifting of it;
- the suction gas is not heated by the discharge gas;
- the free lifting of the piston in the compressor can be designed according to the operating conditions and dimensions of the existing or of a new designed compressor, with the possibility of using together or separately the free lifting piston solutions with the inclined compression chambers and/or magnetic pillow;
- the full length of the piston, the existing positioning and dimensioning of the rider rings and piston rings are maintained, including the existing restrictions imposed by the relative position of the piston in the cylinder and the valve orifices, without being necessary to change their relative position, while maintaining the availability of making the compression chamber inclined in the piston head;

extending the possibility of sliding of the piston in the cylinder liner, with low friction, over the entire length of the stroke by introducing the magnetic pillow, with the possibility of simultaneous or separate realization of the free lifting effect, in any of the configurations chosen and depending on the necessities and/or the conditions and technical specifications for which conversion is easier to apply.

SHORT DESCRIPTION OF THE DRAWINGS

Figure 3:
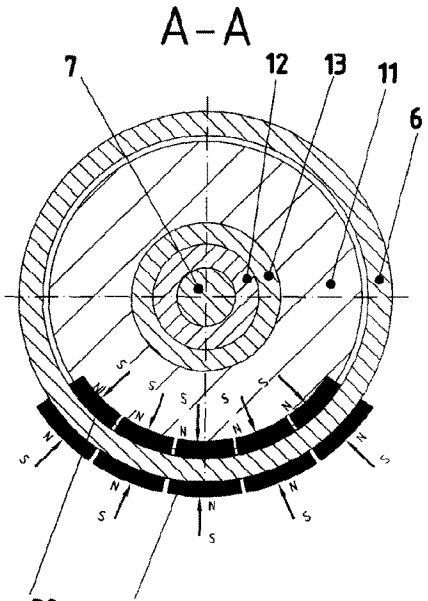
Figure 2:
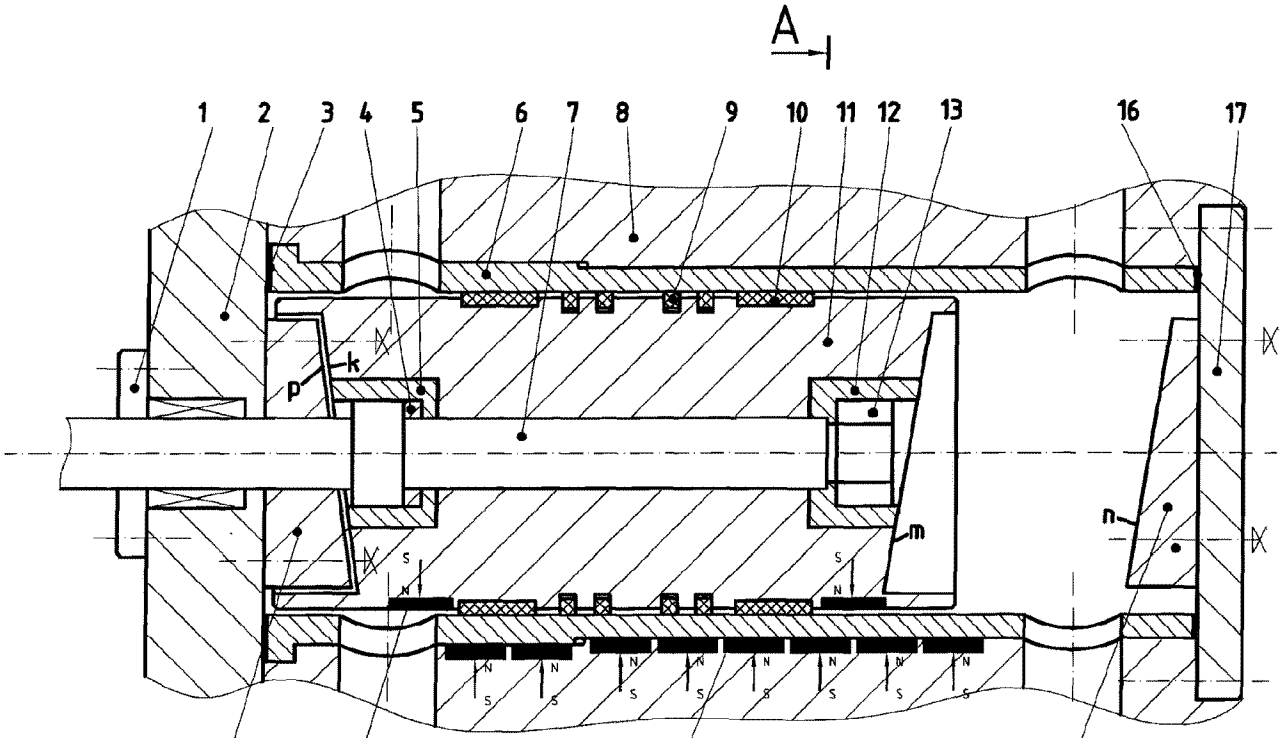

FIG. 1: Horizontal gases compressor with free lifting piston—section;

FIG. 2: cylinder cross-section of horizontal, gas compressor, with inclined heads and inclined compression chambers, equipped with permanent magnets;

FIG. 3: cross section thru piston and cylinder liner, equipped with permanent magnets

DETAILED DESCRIPTION OF THE INVENTION

The horizontal compressor gas piston compressor includes: a crankcase (29) in which a crankshaft (28) is mounted, a connecting rod (27) fixed to a crosshead (26) thru a bolt (25) which alternately drives in a cross-head body (23) a piston rod (7) into some distance pieces (22 and 21), and a cylinder body (8). The separation of the oil from the crankcase is done through an oil wiper case (24) and the gas sealing of the compression chamber is made through an auxiliary gas packing (20) and a main gas packing (1). Suction and discharge of the compressed gas is made through some valves (14 and 18) which are fixed in some valve covers (15 and 19). A cylinder body (8) contains a cylindrical liner (6) in which, rectilinear and alternatively moving is an improved piston (11) equipped with some guiding bushings (5 and 12) provided with straight ends and inclined compression chambers (k) and (m) with the same angle and in the same plane as zone (n) of a cylinder head element (32) mounted on a cylinder head (17), and zone (p) of a cylinder head element (33) mounted on a cylinder head (2), through which a piston (11) is free lifting on the stroke length. A piston (11) is mounted on a piston rod (7) through a piston nut (13) and is equipped with some rider rings (10) arranged in some channels of a piston (11) to assure the mounting of a piston (11) and a piston rod (7) without direct contact with a cylinder liner (6) and some piston segments (9) located in some channels of a piston (11) for gas compression and sealing of a piston (11) into a cylinder (8), along the length of the stroke.

In order to have additional free lifting effect and [[the]] reduced friction movement, some magnets (30) are fixed on a piston (11) and some magnets (31) fixed in a cylinder (8) on the outside diameter and on the lower part of a cylinder liner (6). Suction of the gas is made through some valves (14) along the length stroke of a piston (11) in a cylinder (8) and with compression of the gas on the return stroke of a piston (11). The free lifting of the piston is made by the action of the gas pressure in a inclined chamber until the end of the stroke, when some discharge valves (18) are opened; the free lifting action is concurrent and opposed as an event on the double stroke of a piston (11) with a present and alternate effect at each compression sequence on the alternate movement of a piston (11), when gas suction is made in the head of a cylinder (8) from the cylinder head (17), concurrent with compressing of the gas between a piston (11) and a cylinder head (2) and a cylinder head element (33) and, respectively, suction of the gas on the return stroke of a piston (11) through some suction valves (14) and compressing of the gas between a piston (11) and a cylinder head (17) and a cylinder head element (32).

The invention described above is not limited only at the disclosed example, respectively only to horizontal compressors with a single cylinder; the solution can be applied also to the horizontal compressor with many cylinders.

The invention claimed is:

1. A reciprocating gas horizontal compressor with a free lifting piston, the compressor including a crankcase, a crankshaft, a cross head, a distance piece, a cylinder, a piston rod, an oil wiper case, an auxiliary gas case, a main gas case, suction valves and discharge valves, wherein the piston has some straight ends and some inclined compression chambers (m) and (k) which make, together with zone (n) from a first inclined cylinder head element and zone (p) from a second inclined cylinder head element, two inclined gas compression chambers in the cylinder, one at each end of the cylinder for gas compression, wherein free lifting of the piston along the length of the stroke is by direct action of the pressure on the inclined surfaces of the piston head, and the compressor is provided with permanent magnets fixed to a lower part of the piston on two or more rows, and permanent magnets fixed in the cylinder under a cylinder liner, the permanent magnets under the liner creating a magnetic field opposed to a field created by the permanent magnets on the lower part of the piston that produces simultaneous free lifting and sliding effects on the piston, without friction or with low friction over the entire length of the stroke.

2. The reciprocating gas horizontal compressor according to claim 1, wherein the first inclined cylinder head element is fixed to a first cylinder head and the second inclined cylinder head element is fixed to a second cylinder head at the other end, respectively zones (n) and (p).

3. A reciprocating gas horizontal compressor with a free lifting piston, the compressor including a crankcase, a crankshaft, a cross head, a distance piece, a cylinder, a piston rod, an oil wiper case, an auxiliary gas case, a main gas case, suction valves and discharge valves, wherein the piston has some straight ends and some inclined compression chambers (m) and (k) which make, together with zone (n) from a first inclined cylinder head element and zone (p) from a second inclined cylinder head element, two inclined gas compression chambers in the cylinder, one at each end of the cylinder for gas compression, wherein free lifting of the piston along the length of the stroke is by direct action of the pressure on the inclined surfaces of the piston head, and the compressor is provided with permanent magnets fixed to a lower part of the piston on two or more rows, and permanent magnets fixed in the cylinder under a cylinder liner, the permanent magnets under the liner creating a magnetic field opposed to a field created by the permanent magnets on the lower part of the piston that produces simultaneous free lifting and sliding effects on the piston, without friction or with low friction over the entire length of the stroke, wherein the piston is equipped with two guiding bushings with inclined faces mounted on the piston rod, so that the inclined faces of the bushings form part of the inclined compression chambers (m) and (k), and together with inclined zones (n) and (p) of the first and second inclined cylinder head elements fixed to the first and second respective cylinder heads, make the two gas compression chambers that allow free lifting of the piston within the limit of the clearances at the end of the stroke opposite to zones (n) and (p) from the first and second respective cylinder heads.

4. The reciprocating gas horizontal compressor according to claim 1, wherein the inclined zones (n) and (p) of the cylinder heads, together with similar inclined angles of the inclined compression chambers (m) and (k) respectively from the piston ends, keep the clearance at each end of the piston stroke.

5. The reciprocating gas horizontal compressor according to claim 2, wherein the inclined zones (n) and (p) of the cylinder heads, together with similar inclined angles of the inclined compression chambers (m) and (k) respectively from the piston ends, keep the clearance at each end of the piston stroke.

6. The reciprocating gas horizontal compressor according to claim 3, wherein the inclined zones (n) and (p) of the cylinder heads, together with similar inclined angles of the inclined compression chambers (m) and (k) respectively from the piston ends, keep the clearance at each end of the piston stroke.

7. A reciprocating gas horizontal compressor with a free lifting piston, the compressor including a crankcase, a crankshaft, a cross head, a distance piece, a cylinder, a piston rod, an oil wiper case, an auxiliary gas case, a main gas case, suction valves and discharge valves, wherein the piston has some straight ends and some inclined compression chambers (m) and (k) which make, together with zone (n) from a first inclined cylinder head element and zone (p) from a second inclined cylinder head element, two inclined gas compression chambers in the cylinder, one at each end of the cylinder for gas compression, and free lifting of the piston is by direct action of the pressure on the inclined surfaces of the piston head, and the compressor is provided with permanent magnets fixed to a lower part of the piston on two or more rows, and permanent magnets fixed in the cylinder under a cylinder liner, the permanent magnets under the liner creating a magnetic field opposed to a field created by the permanent magnets on the lower part of the piston that produces simultaneous free lifting and sliding effects on the piston, without friction or with low friction over the entire length of the stroke, wherein the cylinder has at both ends inclined compression chambers, made from the two inclined compression chambers (m) and (k) in the piston, and the first inclined cylinder head element is fixed to a first cylinder head, and the second inclined cylinder head element is fixed to a second cylinder head at the other end, respectively zones (n) and (p), wherein the piston is equipped with two guiding bushings with inclined faces mounted on the piston rod, so that the inclined faces of the bushings form part of the inclined compression chambers (m) and (k), and together with inclined zones (n) and (p) of the inclined cylinder head elements fixed to first and second cylinder heads, respectively make the two gas compression chambers for free lifting of the piston within the limit of the clearances at the end of the stroke opposite to zones (n) and (p) from the first and second respective cylinder heads, and wherein the inclined zones (n) and (p) of the cylinder heads, together with similar inclined angles of the inclined compression chambers (m) and (k) respectively from the piston ends, keep the clearance at each end of the piston stroke.

* * * * *